United States Patent [19]

Stöver

[11] 4,119,885

[45] Oct. 10, 1978

[54] CATHODE RAY TUBE

[75] Inventor: Johannes Hinderikus Stöver, Eindhoven, Netherlands

[73] Assignee: U.S. Philips Corporation, New York, N.Y.

[21] Appl. No.: 794,394

[22] Filed: May 6, 1977

Related U.S. Application Data

[63] Continuation of Ser. No. 646,039, Jan. 2, 1976, abandoned.

[30] Foreign Application Priority Data

Jan. 12, 1975 [DE] Fed. Rep. of Germany ..... 2555765

[51] Int. Cl.[2] ..... H01J 31/00

[52] U.S. Cl. ..... 313/479; 313/450

[58] Field of Search ..... 313/450, 477, 479, 481, 313/482

[56] References Cited

U.S. PATENT DOCUMENTS

| | | | |
|---|---|---|---|
| 2,820,166 | 1/1958 | Pinotti | 313/442 X |
| 2,829,292 | 4/1958 | Krause | 313/450 |
| 2,836,751 | 5/1958 | Turnbull et al. | 313/450 |
| 3,758,802 | 9/1973 | Kubo et al. | 313/479 |

FOREIGN PATENT DOCUMENTS

| | | | |
|---|---|---|---|
| 1,226,728 | 3/1971 | United Kingdom | 313/481 |

*Primary Examiner*—Robert Segal
*Attorney, Agent, or Firm*—Frank R. Trifari; Algy Tomoshunas

[57] ABSTRACT

A cathode ray tube having a glass envelope with a conductive layer covering a portion of the inner surface of the envelope. The major part of the surface covered by the conductive layer is relatively rough to obtain good adhesion of the conductive layer. An electrode within the tube is connected electrically to the conductive layer by a contact spring that presses against a limited region of the conductive layer. The area of the glass surface that is directly behind this limited region is made sufficiently smooth to prevent the contact spring from being held out of engagement with the conductive layer by glass protuberances projecting through the conductive layer and causing arcing between the contact spring and adjacent areas of the conductive layer.

1 Claim, 5 Drawing Figures

CATHODE RAY TUBE

This is a continuation, of application Ser. No. 646,039, filed Jan 2, 1976 now abandoned.

The invention relates to a cathode ray tube for displaying pictures and comprising in an evacuated glass envelope means to generate at least one electron beam, a display screen on a well part of the envelope which constitutes the display window, an electrically conductive layer on a wall part of the envelope which is present between the said means and the display screen, and an electrode which is connected to said layer by means of a contact spring which presses against the conductive layer.

Such a cathode ray tube is known from the United States Patent Specification 2,829,292, in which resilient contacts constitute the connection between one of the electrodes of the means to generate an electron beam and an electrically conductive layer. This layer in turn constitutes the connection to the display screen which serves as a target for the said electron beam(s) and hence obtains the character of a second anode. It is the object of the conductive layer to create a field-free space also in a region of the cathode ray tube where the electron beam(s) is not deflected. In similar cathode ray tubes of the shadow mask type which are used for the display of colour pictures, the so-called shadow mask which is usually connected to the conductive layer via resilient contacts is present in front of the display screen.

It has been found that at the area where the resilient contacts press against the conductive layer (the contact place) electric flash-overs (sparks) occur. As a result of said flash-overs, the conductive layer is sputtered away around the contact place after a number of hours in operation, so that the distance over which the flash-overs take place becomes larger. It has been found that said phenomenon can even become visible on the display screen. Moreover, such flash-overs may damage electronic circuits in the device in which the cathode ray tube is present.

It is the object of the invention to prevent such flash-overs and to ensure a good contact and to maintain the good adhesion of the conductive layer to the envelope.

According to the invention, a cathode ray tube of the kind mentioned in the first paragraph is characterized in that the glass surface of the envelope below said conductive layer is rough with the exception of the place where the contact spring presses against the conductive layer, in which place the glass surface is smoothed over a small surface part. This can be realized by polishing the glass surface of the envelope below the conductive layer or by smoothing the die with which the envelope is manufactured in and around the place where the contact point will be provided.

The invention is based on the recognition that the sparks occur when the contact spring presses on a projection of the glass protruding through the conductive layer. In this case the contact is maintained only by flash-overs. The roughness of the glass which is the cause of the projections, however, promotes a good adhesion of the conductive layer to the envelope. With the construction according to this invention a good adhesion of the layer is ensured and a good contact is obtained in which no flash-overs occur.

Below the contact spring the surface roughness of the glass should be at least 25% smaller than the layer thickness of the conductive layer.

The conductive layer preferably has a thickness between 8 and 12 μm. The glass surface preferably has a surface roughness of approximately 20 μm (approximately 800 ru) and at the area of the contact less than 3 μm (approximately 120 ru). Surface roughness is to be understood to mean herein the average of the absolute values of the deviation from a 100% smooth surface which indicates the average level of the surface with which a sensing pin having a radius of curvature R of 3 μm is measured.

The invention will now be described in greater detail with reference to a drawing in which:

FIG. 2 shows a bad contact, while

FIG. 4 shows the influence of the use of the invention, while

Figure 1:
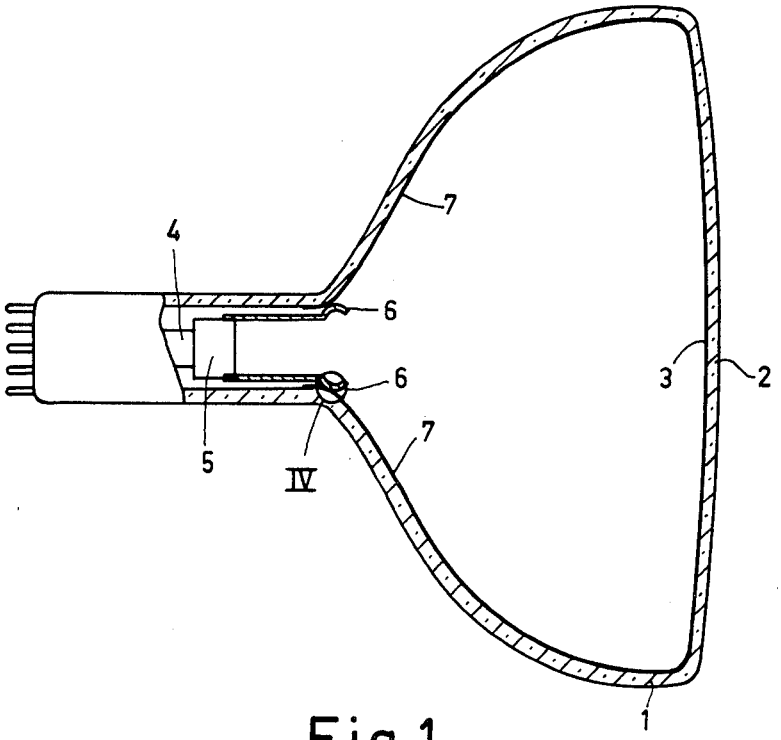
FIG. 1 shows a cathode ray tube according to the invention.

FIG. 1 shows a cathode ray tube according to the invention. A display screen 3 is present in the evacuated envelope 1 on the wall part which constitutes the display window 2. The envelope 1 moreover comprises means 4 to generate an electron beam. In most cathode ray tubes the last electrode 5 of the said means 4 are brought at a high potential to accelerate the electron beam. Said high potential is applied via contact springs 6 extending from the electrode 5 and contacting the conductive layer 7 which is present on a wall part between the display screen 3 and the said means 4.

Figure 2:
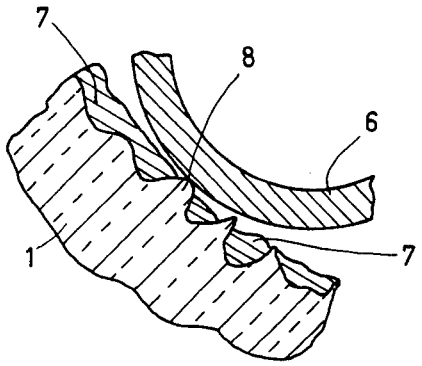
Figure 3:
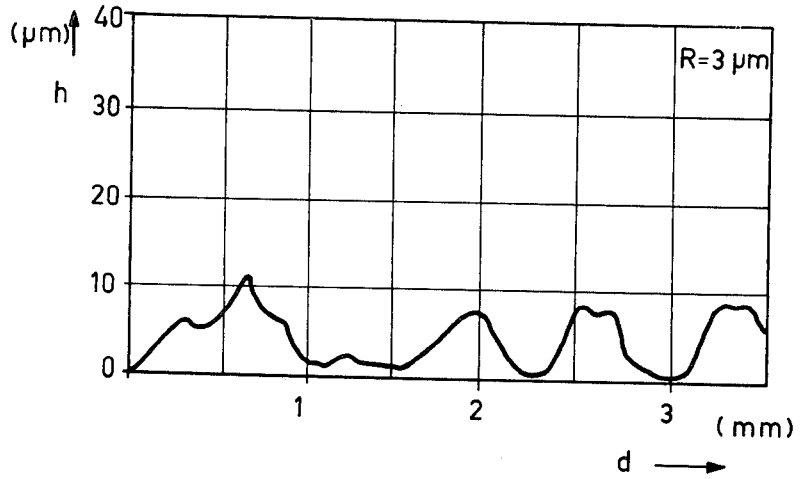
FIG. 3 shows a graph indicating the glass roughness measurement.

The part of the envelope which is covered with the conductive layer is rather rough (see also FIG. 3). This has for its result that, as is shown in FIG. 2, projections of the glass 8 protrude through the conductive layer 7. This is the case in particular when the conductive layer is provided by spraying. When the metal contact spring 6 presses against such a projection 8, sparks will cause the transport of charge carriers from the conductive layer 7 to the contact spring 6. As a result of this the conductive layer 7 is sputtered away near the cantact point and the track to be covered by the sparks becomes larger.

FIG. 3 shows a glass roughness measurement. This measurement has been performed with a sensing instrument, A very sharp sensing pin suspended from an extremely truly processed parallel guide is dragged over the surface to be checked. The measuring pressure is extremely low so that no scratches are formed. The sensing pin which has a given radius of curvature follows nearly all unevenesses of the surface. The relative horizontal movement $d$ and vertical movement $h$ of the sensing pin are shown on an enlarged scale in FIG. 3. In the case of FIG. 3 the radius of curvature of the sensing pin is 3 μm. Therefore FIG. 3 is a very good representation of the rough glass surface.

Taking into account the fact that the conductive layer usually has a thickness from 8 to 12 μm, it will be obvious that projections of the glass protrude through the conductive layer.

Figure 4:
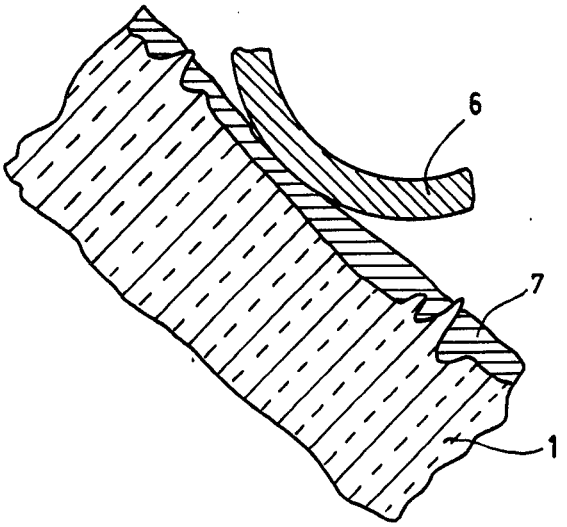

It will be obvious from FIG. 4 that at the area of the contact of contact spring 6 with the conductive layer 7 a readily conductive contact which does not give rise to the formation of sparks has been obtained by smoothing the glass surface of the envelope 1.

Figure 5:
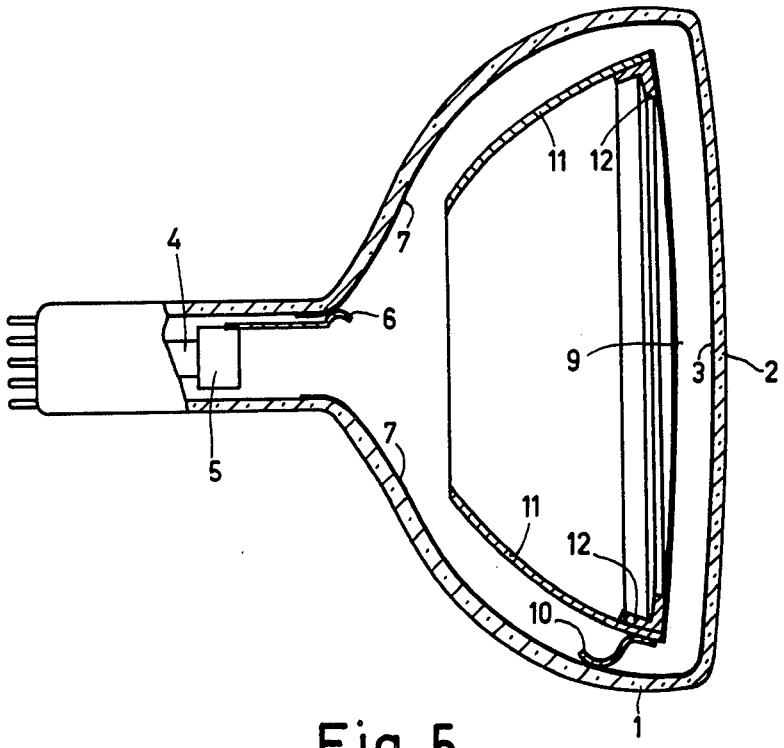
FIG. 5 shows a cathode ray tube for displaying coloured pictures.

It will be obvious that the invention is not restricted to cathode ray tubes shown in FIG. 1 and that it also relates to cathode ray tubes for displaying coloured pictures as is shown in FIG. 5. This kind of tubes is usually provided with a colour selection electrode 9 (also termed shadow mask) which is secured to a supporting frame 12 and consists of a plate-shaped electrode having round or elongate apertures which is present in front of the display screen and is conductively connected to the conductive layer by means of contact springs 10. Such a cathode ray tube usually comprises in addition a screening cap 11. The invention can successfully be used in those cases in which a good high voltage contact by means of contact springs with the conductive layer is necessary.

I claim:

1. A cathode ray tube comprising:

an evacuated glass envelope; beam generating means to generate at least one electron beam;

a display screen on a wall part of the envelope which constitutes the display window;

an electrically conductive layer on a wall part of the envelope between the said beam generating means and the display screen;

an electrode;

a contact spring electrically connected to said electrode and resiliently pressing against the conductive layer, the glass surface of the envelope below said conductive layer being relatively rough with a surface roughness of approximately 20 μm and comprising projections that extend through said conductive layer with the exception of a limited area where the contact spring presses against the conductive layer the glass surface in said limited area being relatively smooth with a surface roughness of less that 3 μm and being substantially completely devoid of projections extending through said conductive layer in said limited area the thickness of said conductive layer in said limited area being between 8 and 12 μm, whereby said contact spring electrically engages said conductive layer within said area.

* * * * *

UNITED STATES PATENT OFFICE
CERTIFICATE OF CORRECTION

Patent No. 4,119,885 Dated October 10,1978

Inventor(s) JOHANNES H. STÖVER

It is certified that error appears in the above-identified patent and that said Letters Patent are hereby corrected as shown below:

In the Title Page under item [30], Foreign Application Priority Data, change date to read-- Dec. 11,1975--

Signed and Sealed this

*Third* Day of *February 1981*

[SEAL]

*Attest:*

RENE D. TEGTMEYER

*Attesting Officer*

*Acting Commissioner of Patents and Trademarks*